US005937553A

United States Patent [19]

Maran

[11] Patent Number: 5,937,553

[45] Date of Patent: Aug. 17, 1999

[54] POP-UP POLYHEDRON GREETING CARD

[76] Inventor: Daniel L. Maran, 3225 Glenbrook Dr., Lansing, Mich. 48911-2221

[21] Appl. No.: 09/006,004

[22] Filed: Jan. 12, 1998

Related U.S. Application Data

[60] Provisional application No. 60/040,812, Mar. 18, 1997.

[51] Int. Cl.[6] ..... G09F 1/06

[52] U.S. Cl. ..... 40/124.08; 40/124.14

[58] Field of Search ..... 40/124.09, 124.08, 40/124.14, 787, 539; 446/488; 428/8, 9

[56] References Cited

U.S. PATENT DOCUMENTS

| | | | |
|---|---|---|---|
| 3,267,597 | 8/1966 | Jannes | 40/124.14 X |
| 3,571,958 | 3/1971 | Stevens et al. | 40/124.14 |
| 4,235,032 | 11/1980 | Robinson | 40/539 |
| 4,309,835 | 1/1982 | Naeve | 40/310 |
| 4,319,418 | 3/1982 | Transport | 40/124.14 |
| 4,586,649 | 5/1986 | Webinger . | |
| 4,773,622 | 9/1988 | Herlin | 40/539 X |
| 4,794,024 | 12/1988 | Crowell et al. . | |
| 4,854,060 | 8/1989 | Corbo et al. | 40/539 X |
| 5,010,669 | 4/1991 | Moran | 40/539 |
| 5,096,751 | 3/1992 | Duchek | 40/538 X |
| 5,259,133 | 11/1993 | Burtch . | |
| 5,651,715 | 7/1997 | Shedelbower | 446/488 X |

FOREIGN PATENT DOCUMENTS

| | | |
|---|---|---|
| 603388 | 6/1948 | United Kingdom . |
| 808856 | 2/1959 | United Kingdom . |

*Primary Examiner*—Joanne Silbermann
*Attorney, Agent, or Firm*—Richard C. Litman

[57] ABSTRACT

A pop-up polyhedron greeting card or the like, is formed of two identical blanks which are adhesively secured together about the inwardly folded flanges of the trapezoidal faces of the device. Opposed inward flanges are tied together using an elastic band or cord, with the cord urging the two opposite flanges together to erect the card, to form a three dimensional polyhedral shape symmetrical about its equatorial plane. Various attachment embodiments are provided for the elastic band within the device, thus ensuring that the band will not become disengaged from its attachment points, regardless of the variation of tension on the band between the collapsed and erected states of the device. The device may be secured or suspended from another surface or object by using a magnet secured to one face of the device, for attachment to a magnetic object (refrigerator door, etc.), or by using a hook extending from one of the two central faces so the device may be suspended, e. g., Christmas tree ornament, etc. Applications of the polyhedral card device include greeting cards, calendars, advertisements, coin depositories or the like, and the display of other informational and graphical indicia.

12 Claims, 5 Drawing Sheets

POP-UP POLYHEDRON GREETING CARD

REFERENCE TO RELATED PATENT APPLICATION

This application claims the benefit of U.S. Provisional patent application Ser. No. 60/040,812, filed on Mar. 18, 1997.

BACKGROUND OF THE INVENTION

1. Field of the Invention

The present invention relates to self-erecting, collapsible polyhedral structures having greeting card indicia or other informational or graphical indicia thereon, and more specifically, to means for securing the interior self-erecting components.

2. Description of the Prior Art

Self-erecting, or "pop-up" structures with collapsible properties have been the subject of several patents. These devices enable the expansion of a flattened interconnected assembly of specially configured sheets of material into a three-dimensional polyhedral structure, the faces thereof having indicia thereon for display. Many applications for these devices exist, including calendars, advertisements, desk-top decorations, greeting cards, and other novelty items. A discussion of the related art known to the present inventor, and its differences and distinctions from the present invention, is provided below.

U.S. Pat. No. 4,309,835 issued on Jan. 12, 1982 to Don A. Naeve describes a Foldable Frame Structure, in which some indicia, graphics, etc., may be displayed. The resulting device serves as a frame for such indicia or graphics, and hence does not a define a polyhedron symmetrical about an equatorial plane, as in the present invention. Moreover, no means is disclosed by Naeve to hold the structure in an erect configuration by internal elastic bands, as provided by the present structure.

U.S. Pat. No. 4,586,649 issued on May 6, 1986 to George P. Weblinger describes a Food Package for popping popcorn. The package may be folded to form a three dimensional polygonal enclosure, but the device is permanently closed during manufacture, after the contents (popcorn) are placed therein. The structure is opened after heating, by a tear strip across the top. Moreover, the device is not symmetrical about an equatorial plane, as in the present polyhedral structure. As the Weblinger device is permanently sealed by adhesively secured flaps, Weblinger is silent regarding any means for allowing the device to be temporarily folded or erected multiple times, as provided by the present structure.

U.S. Pat. No. 4,773,622 issued on Sep. 27, 1988 to Robert M. Herlin describes a Self-Erecting Display Device for use in advertising and novelty device applications. Two panels (or a single panel having two major parts, joined along one edge) are provided, with each having a central regular polygon with a corresponding number of trapezoidal panels extending from the edges of the polygons. The outer edges of the trapezoids of one panel are secured to the corresponding outer edges of the trapezoids of the second panel, to form a flat structure formed of two congruent sheets of material. An elastic band is installed across opposite internal flanges along the equator of the device, to pull the trapezoidal faces inward and provide a three dimensional, symmetrical polyhedral structure. The device may be collapsed as desired by pushing the two central polygons together, thereby pushing the opposing outer edges of the trapezoidal faces apart, against the tension of the elastic band. The Herlin device differs from the present invention, in that the two components used to form the structure are not symmetrical, thus requiring two special components. The present collapsible polyhedral structure is formed of two identical components, thus easing the construction of the device and simplifying the forming of the parts. Also, the configuration of the hook means described by Herlin present a potential problem. In that the endless elastic bands must tolerate frequent contraction and expansion in facilitating the respective compression and expansion of the device, the stable fixation of the endless elastic bands within the device is essential. The hook securing means disclosed by Herlin cannot insure reliable immobilization of the endless elastic bands integral to the operation of the pop-up polyhedral devices. Hence, a significant chance exists that the endless elastic bands will be disengaged within the polyhedron, ultimately compromising the smooth operation of a device employing such hook securing means.

U.S. Pat. No. 4,794,024 issued on Dec. 27, 1988 to Christopher S. Crowell et al. Describes Stabilizer And Rigified Pop-Up Structures Resembling Solid Polyhedrons. The structure is formed essentially as the Herlin structure discussed above, but the inwardly turned glue tabs are each formed to overlap one another internally, resulting in the interengagement of each of the sides of the three dimensional structure with one another to preclude uneven deployment of the structure. While the blanks for the two sides of the device are symmetrical, unlike the Herlin polyhedral structure, Crowell et al. use the same internal hook means for securing the elastic band within the structure, with the limitations and insecurity of this means as discussed above.

U.S. Pat. No. 5,010,669 issued on Apr. 30, 1991 to George Moran describes a Post Card With Pop-Out Figure, wherein a portion of the card is folded back to form a stand, with the remainder of the card remaining upright above the stand. The device does not form a regular polyhedron, as accomplished by the present invention, nor is any internal means allowing for the selective collapsing and expanding of the device disclosed, as provided by the present invention.

U.S. Pat. No. 5,096,751 issued on Mar. 17, 1992 to Donna J. Duchek describes a Pop-Up Rolling Greeting Card, having a central structure similar to that of the Herlin and Crowell et al. devices discussed above. Duchek includes opposite circular discs on each parallel face of the polyhedral structure, allowing the device to be rolled.

U.S. Pat. No. 5,259,133 issued on Nov. 9, 1993 to Ronald P. Burtch describes a Pop-Up Display Device similar to the Moran device discussed further above, but incorporating a sliding panel in the base which is connected to the pop-up portion of the card. When the sliding panel is pulled, the pop-up portion is erected for display. No three dimensional polygonal structure is disclosed by Burtch.

British Patent Publication No. 603,388 accepted on Jun. 15, 1948 describes Improvements In Dummy Containers And Other Hollow Devices For Display Purposes. The device comprises a flat sheet which is rolled into a cylinder, with a tab and slot for locking the ends together to close the cylinder. Upper and lower lids are provided, which are resiliently secured to each end of the cylinder by an internal elastic band secured between the two lids. No folding polyhedral structure is disclosed.

Finally, British Patent Publication No. 808,856 published on Feb. 11, 1959 describes Improvements In Display Devices, in which two flat panels are folded generally vertically and connected together to form a free standing caricature. Other components are formed of flat sheets to add further appearance details. The resulting device is not a regular, closed polyhedron, as in the present invention, and no elastic means is disclosed for holding the device in an erect position, as provided in the present invention.

While flat folding, pop-up polyhedrons have been developed in the past, as exemplified by the devices of the '622 and '024 U.S. patents respectively to Herlin and Crowell et al., the means used to urge the panels to an erect, three dimensional configuration is not particularly secure, comprising a relatively open hook formed in opposed internal flanges, between which a rubber band or the like is stretched. Continued flexing of the device, particularly when it is in its erected state and the two opposed hooks are at their closest proximity to one another, may cause the band to slip from one of the hooks due to the relative slack in the band caused by the shorter distance between the attachment points. In contrast, the present pop-up polyhedral structure includes much more positive means of securing the ends of the elastic band, to preclude slippage from the attachment points and to provide a durable structure.

Furthermore, the above patents describing pop-up polyhedral devices do not suggest means for the unobtrusive positioning and displaying thereof. This restricts the placement of the disclosed devices to flat surface areas. These flat surface areas, such as desks, tables and counter-tops, are often occupied by other items that infringe the space required for the convenient and prominent placement of the pop-up polyhedral devices. Placement of the pop-up polyhedral devices, in turn, disrupts the otherwise orderly arrangement of such surface-bound items.

In light of the these shortcomings, there is a need for a pop-up polyhedron greeting card having means for securely fixing the self-erecting operational components of pop-up polyhedral devices therein. There is also a need for a pop-up polyhedron greeting card having means for positioning and displaying the pop-up polyhedral device in unobtrusive ways. None of the above inventions and patents, taken either singly or in combination, is seen to describe the instant invention as claimed.

SUMMARY OF THE INVENTION

The pop-up polyhedron of the present invention incorporates means for securely fixing the self-erecting operational components therein and means for positioning and displaying the pop-up polyhedron in unobtrusive ways. Three embodiments of the present invention each facilitate the secure immobilization of self-erecting operational components within the established pop-up polyhedron structure. Each embodiment involves the trapezoidal member opposingly disposed within the hollow enclosure of the pop-up polyhedron, and the self-erecting operational components secured to the opposing trapezoidal members.

In the preferred embodiment of the invention, opposing trapezoidal members comprise an aperture-tab combination for securing an endless elastic member within the pop-up polyhedron. The endless elastic member engages the aperture and tab of each opposing trapezoidal member, establishing a secure connection therebetween. In an alternative embodiment of the invention, the opposing internal flanges define an aperture for securing end retainers of an elongate elastic member. The retainers are perpendicular to and angularly rotatable with respect to the elongate elastic member, and deform to insertably engage the apertures of both opposing internal flanges, to ultimately secure the elongate elastic member thereto. Another alternative embodiment of the invention comprises a notch-slit combination for securing pop-up operational components within the polyhedron structure. An elongate elastic member having knots on both of its ends slidably engages the slits defined by opposing internal flanges, until both knots of the elongate elastic members are adjacent to the notches on the respective internal flanges, to ultimately secure the elongate elastic member therebetween.

The present invention also incorporates means for positioning and displaying the pop-up polyhedral device in unobtrusive ways. A one-sided adhesive magnetic strip is affixed to one face of the pop-up polyhedron, enabling its removable attachment to magnetic surfaces, such as refrigerator doors, for the temporary display of a pop-up polyhedron and the indicia thereon. Additionally, suspension means enable the re-positionable unobtrusive placement and display of the pop-up polyhedron. A suspension member having a three-piece hook inserts into an aperture on the top surface of the pop-up polyhedron, to facilitate the suspension thereof.

Accordingly, it is a principal object of the invention to insure the reliable immobilization of the self-erecting operational components integral to pop-up polyhedral devices.

It is another object of the invention to incorporate an improved structural design in pop-up polyhedral devices that tolerates the frequent contraction and expansion of the elastic means for facilitating compression and expansion of pop-up polyhedral devices.

It is a further object of the invention to allow the unobtrusive positioning and displaying of the pop-up polyhedral device.

Still another object of the invention is to promote the increased usage of pop-up polyhedral devices for displaying informational and graphical indicia.

An additional object of the present invention is to provide for the construction of a pop-up polyhedral device formed of two identical flat blanks or sheets.

It is also an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises a pop-up, polyhedron card or the like, formed of two identical sheets of material which are joined along their congruent peripheral edges to form polygonal structures when expanded. The structures are symmetrical about their equatorial planes, defined by the joint between the two sheets. A detailed discussion of the present polyhedral structures is presented further below.

Figure 1A:
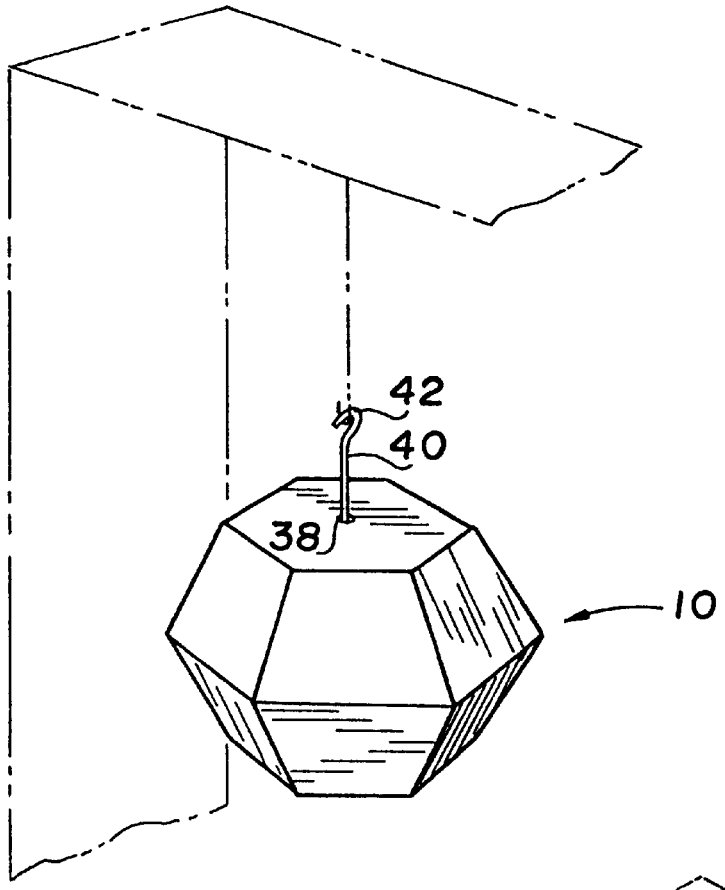
FIG. 1A is an environmental view of the present invention, suspended from an overhead member.
Figure 1B:
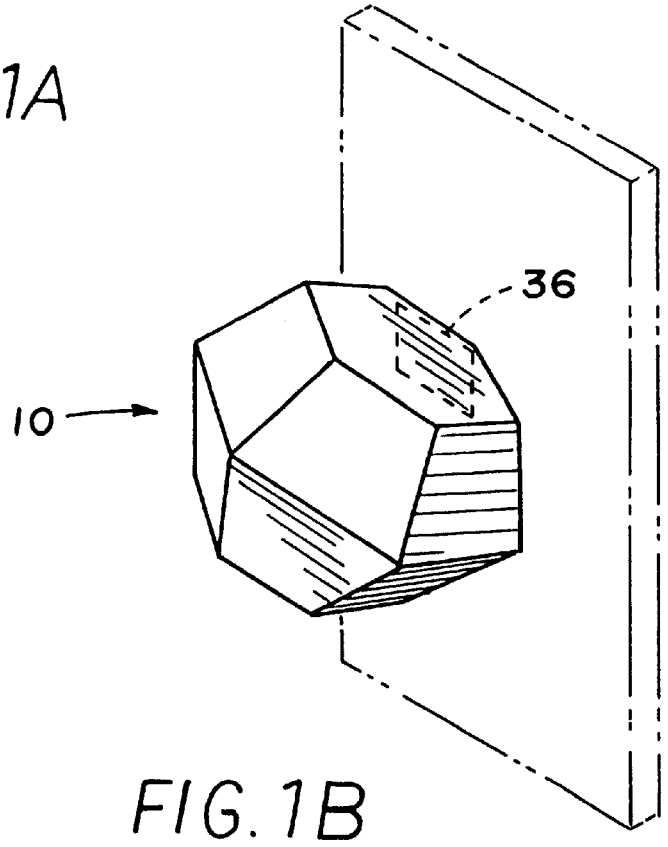
FIG. 1B is an environmental view of the present invention, magnetically engaging a vertical surface.

FIGS. 1A and 1B disclose different means of attaching or suspending the present polyhedral structure 10 from another article. FIG. 1A discloses hook means for suspending the polyhedron 10 from another structure, with an elongate member 40 having a first end captured within a passage 38 formed within one of the panels (preferably one of the two central panels, as shown in FIG. 1A) and a distal hook end 42. This arrangement enables the polyhedral structure 10 to be used as a Christmas tree ornament, etc.

Figure 5:
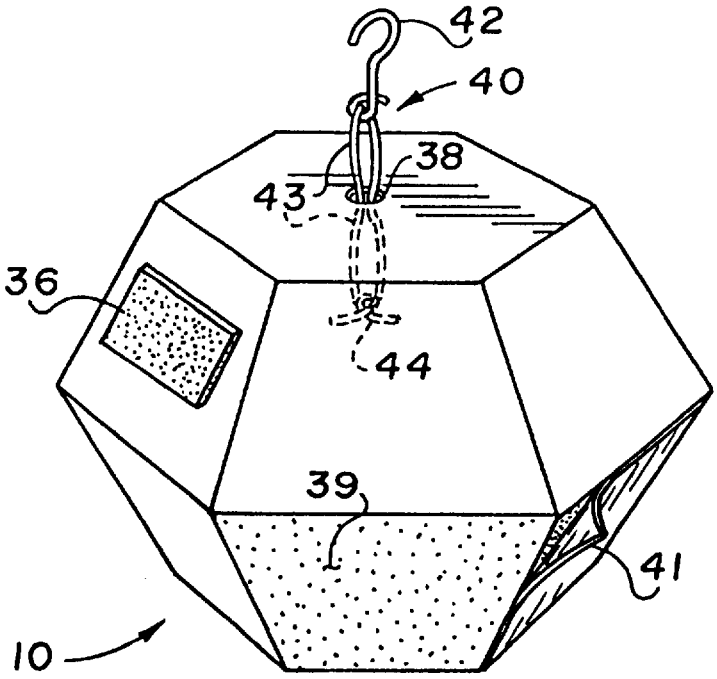
FIG. 5 is a perspective view of the present invention, incorporating means for suspending it from another structure and means for securing it to a magnetic surface.

Alternatively, a thin magnetic sheet 36 may be affixed to one of the panels of the device, thereby allowing the polyhedron 10 to be temporarily and magnetically secured to any suitable magnetically attractive article (e. g., refrigerator door, etc.), as shown in FIG. 1B. FIG. 5 provides a detailed perspective view of the above two described attachment or suspension means for the present polyhedral device 10. In FIG. 5, the elongate member 40 comprises a flexible loop 43, which is removably installed through the aperture or passage 38 by means of an end flange or retainer 44 formed in one end of the loop 43. The retainer 44 may be turned or angled relative to the remainder of the loop 43, to be passed through the passage 38 for installation or removal of the assembly to or from the polyhedron, as desired. The loop 43 attaches to the hook portion 42 to complete the structure.

The magnetic attachment means for the present polyhedral structure 10, as well as other attachment means, is also more closely detailed in FIG. 5. The magnet 36, which may comprise a small, flexible magnetic business card type magnet, or other magnetic means as desired, is affixed to one panel of the polyhedral structure 10. Another panel (or panels, as shown) may include a pressure sensitive adhesive coating 39 thereon, which may be covered by a release sheet 41 prior to use. This adhesive means 39 may be used to secure the polyhedral structure 10 to another article, or may be used for securing any printed material, photograph, or other sheet material to create a customized or personalized greeting card.

Figure 8:
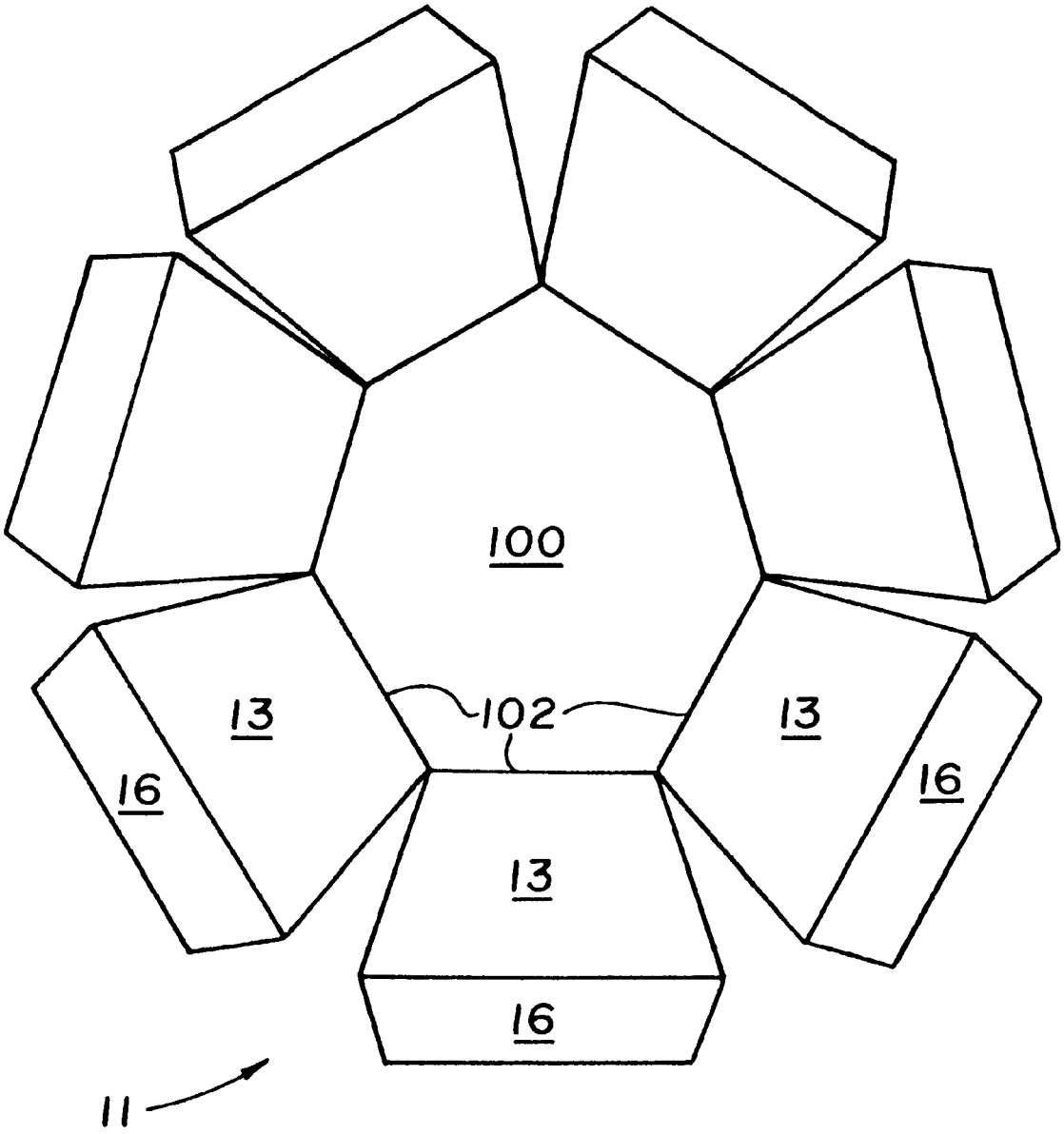
FIG. 8 is a plan view of one of two identical sheets in its flat configuration, which may be used to form a pop-up polyhedron according to the present invention.

The pop-up polyhedron disclosed in FIGS. 1A through 5 includes two parallel central hexagonal panels and six trapezoidal panels extending from the edges of each central panel, thus providing a total of fourteen faces or panels. However, it will be seen that the central panels may have any number of edges from three (i. e., triangular central panels) upward. FIG. 8 illustrates a flat sheet 11 which may be used with an identical such sheet 11 to form a pop-up polyhedron of the present invention. The sheet 11 of FIG. 8 includes a regular seven sided or heptagon central panel 100, by definition having a total of seven peripheral edges 102. Each of the edges 102 has a trapezoidal panel 13 extending outwardly therefrom, for a total of seven such panels 13, with each panel 13 having a flange 16 extending therefrom.

Each of these flanges 16 is folded or doubled over to lie across a portion of its respective panel 13, with the downwardly folded flanges 16 of one sheet 11 being secured (adhesively, etc.) to the upwardly folded flanges 16 of a second identical sheet 11. The resulting flat structure will have an appearance similar to the flat pattern 11 shown in FIG. 8, but without the protruding flanges 16, as they will be folded inwardly between the two sheets 11. When the two panels 11 are expanded to form a polygonal structure, it will be seen that the mating flanges 16 define an equatorial plane of symmetry for the symmetrical polygonal structure thus formed.

Such polyhedral constructions have been developed in the past, as noted in the discussion of the related art further above. The related art polyhedrons also use an elastic member to draw opposite sides of the device toward one another, thereby expanding the flattened structure to form a polyhedron. However, there is a relatively large difference between the collapsed diameter of the device, and the shorter equatorial diameter when the device is expanded to form a polyhedron. This creates a problem, in that the elastic band must provide sufficient slack to allow the device to be collapsed completely without damaging the internal attachments. The elastic members generally provided thus do not have excessive strength when the structure is expanded to form a polyhedron, due to the shorter dimension across the structure. This has led to the elastic member sometimes slipping from its attachment points.

Figure 7A:
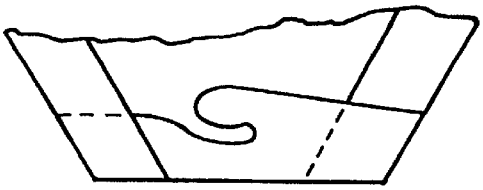
FIG. 7A (PRIOR ART)
FIG. 7A is a broken away plan view of the prior art guide flange means for securing pop-up operational components.
Figure 7B:
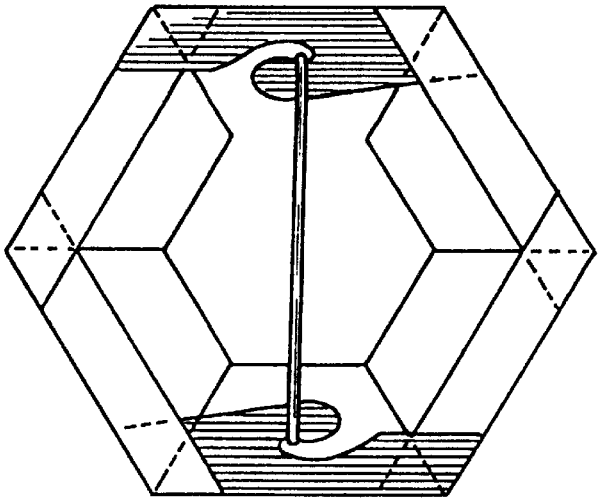
FIG. 7B (PRIOR ART)
FIG. 7B is a plan view in section of the prior art pop-up polyhedral device according to FIG. 7A.
Figure 6A:
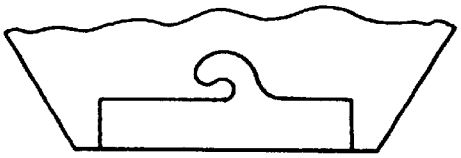
FIG. 6A (PRIOR ART)
FIG. 6A is a broken away plan view of a prior art internal flange with hook means for securing pop-up operational components.
Figure 6B:
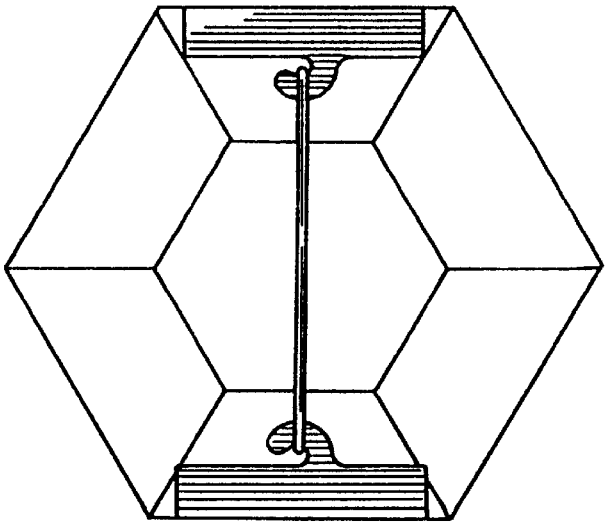
FIG. 6B (PRIOR ART)
FIG. 6B is a plan view in section of the prior art pop-up polyhedral device according to FIG. 6A.

FIGS. 6A and 7A respectively show the elastic band attachment means of the internal flanges of the related art, while FIGS. 6B and 7B respectively show the endless elastic band engaging the attachment means within the pop-up polyhedrons described in the prior art. These flanges extend along the plane of symmetry between the top and bottom halves of the pop-up polyhedrons. It will be noted that the relatively wide hooks comprising the elastic band attachment points, formed along the inwardly facing edges of the opposed internal flanges, place the attachment points relatively closer to one another than such attachment points formed adjacent the outer edges, or at least through the centers of the opposed flanges, as in the present invention.

In contrast, the present pop-up polyhedron embodiments provide much more positive means of securing the elastic band or cord within the structure, as described below. In each of the embodiments of the present invention, the internal flanges include two generally opposed attachment flanges 16. (It will be seen that the general configuration of the attachment flanges 16 is the same as that of the other flanges of the present pop-up polyhedron, and that the attachment flanges 16 differ only in the specific configuration of the elastic band attachment means therein, in each of the embodiments. Hence, a common reference numeral 16 is used for all of the flanges.) Each of the flanges 16 includes an inner edge 110, i. e., the two edges 110 face one another, an opposite outer edge 112, and inwardly tapering first and second lateral edges, respectively 114 and 116.

Figure 2A:
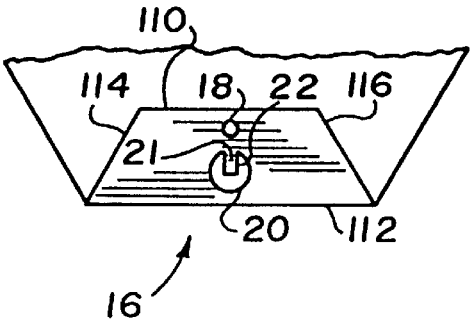
FIG. 2A is a broken away plan view of the internal flange with an aperture-tab combination for securing pop-up operational components, according to the preferred embodiment of the present invention.
Figure 2B:
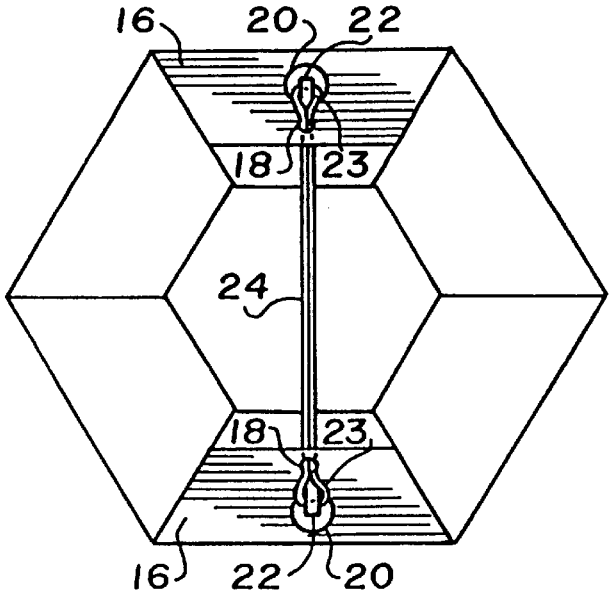
FIG. 2B is a plan view in section of the preferred embodiment of the invention according to FIG. 2A.

The preferred embodiment of the present invention is illustrated in FIG. 2A and FIG. 2B. In FIG. 2A, an internal attachment flange 16 includes a smaller first passage 18 formed through each attachment flange 16 adjacent the inner edge 110 thereof, and a larger second passage 20 formed through each attachment flange 16 adjacent the outer edge 112 thereof. Each of the passages 18 and 20 are in linear alignment with one another, as shown in FIG. 2B.

Each of the second passages 20 includes a peripheral point 21 adjacent the corresponding first passage 18, with a generally rectangular tab 22 extending outwardly from each peripheral point 21, into the corresponding second passage 20. An endless elastic band 24 is passed through the two smaller passages 18, to extend across the internal structure as shown in FIG. 2B. The end loops 23 extending through the smaller passages 18 are looped around the outwardly extending tabs 22, to draw the two opposed attachment flanges 16 together for erecting the two sheets 11 comprising the structure, thereby forming an erected polyhedron generally as shown in FIGS. 1A and 1B.

Figure 3A:
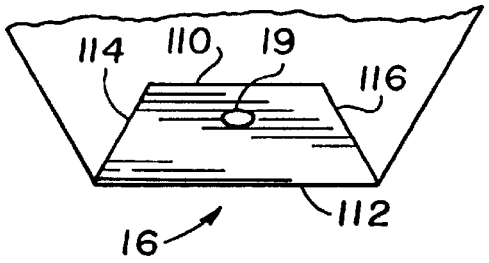
FIG. 3A is a broken away plan view of the internal flange with aperture means for securing pop-up operational components, according to an alternative embodiment of the present invention.
Figure 3B:
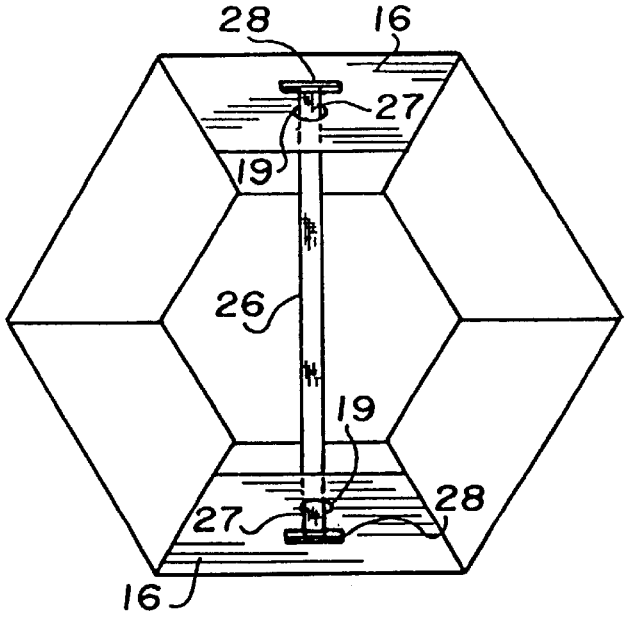
FIG. 3B is a plan view in section of the alternative embodiment of the invention according to FIG. 3A.

In an alternative embodiment of the present invention, illustrated in FIG. 3A, a passage 19 is formed generally centrally through the attachment flange 16, or perhaps somewhat closer to the shorter edge 110 of the attachment flange 16. In FIG. 3B, both opposing attachment flanges 16 incorporate passages 19. An elongate elastic member or band 26, with a first and opposite second end 27, extends across the internal structure of the polyhedral device to draw the opposed attachment flanges 16 and attached structure together. An elongate crossmember 28 is transversely and flexibly secured to each end 27 of the band 26. End crossmembers 28 of the elastic member 26 deform to insertably engage the passages 19 of both opposing attachment flanges 16, ultimately securing elastic member 26 thereto. The end crossmembers 28 may be made of a different material than the band 26, such as a metal crimp, which crossmembers 28 are transversely affixed to elastic member 26, a flattened elastic band. In an alternative variation, a singular plastic strand ending in a "T" end flange operates in the same way as the embodiment employing the multi-piece elastic member-end crossmember component.

Figure 4A:
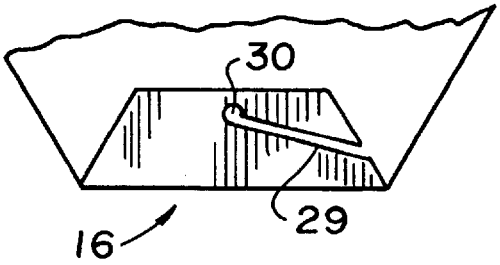
FIG. 4A is a broken away plan view of the internal flange with a notch-slit combination for securing pop-up operational components, according to another embodiment of the present invention.
Figure 4B:
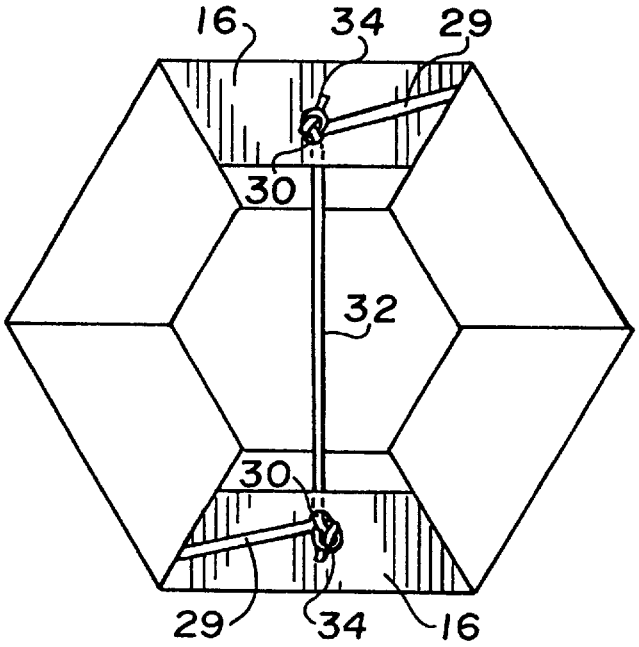
FIG. 4B is a plan view in section of the preferred embodiment of the invention according to FIG. 4A.

FIGS. 4A and 4B illustrate another alternative embodiment of the present invention. In FIG. 4A, the attachment flange 16 includes a slit 29. Slit 29 extends from one of the non-parallel edges of the attachment flange 16 to a passage 30, formed through the attachment flange 16 at the substantial center thereof. The passage 30 communicates with one edge of the attachment flange 16 by means of the slit 29, thus enabling an elongate elastic member 32 to be inserted laterally through the slit 29 and into the passage 30. The elastic member or band 32 has a first and opposite second end 33, with each end 33 having a knot 34 tied therein. A portion of the elastic band 32 adjacent each end 33 is inserted into each of the slits 29, and passed along the slits 29 until the band 32 extends through the passage 30. The ends 33 of the band 32 are thus captured within each corresponding passage 30 by means of the knots 34 formed in each end 33 of the elastic member 32. A variation of this embodiment substitutes an endless elastic member for elongate elastic member 32, whereby the endless elastic member annularly engages the notches 30 of both opposing trapezoidal members 16, to ultimately secure elastic member 32 thereto.

In summary, the various embodiments of the present pop-up polyhedral greeting card, provide additional durability and reliability by means of the more secure internal attachments for the elastic members therein, and further provide additional utility by means of the various attachment features provided.

Such pop-up polyhedrons are characterized by a plurality of foldable side flaps which collapse on themselves to permit a configuration of the polyhedron in a flat orientation. Such polyhedrons may be formed from sheet materials, preferably from sheet plastic of higher gauge to withstand wear, but paperboard or similar compositions may also be used.

In the illustrated embodiments of the prior art pop-up polyhedrons and the modifications shown by the present invention, a 14-sided polygonal body is consistently used, having hexagonal top and bottom surfaces, six upper sidewalls and six lower sidewalls. Other shapes and geometrical embodiments are possible in both the prior art and in the present invention. However, FIG. 8 suggests a preferred, plan view of an odd sided polyhedral shape 11, useful in preparing the pop-up polyhedron 12 having a total of 16 sides. In one suggested use, the 16 sided figure is particularly suitable for a 12 month calendar in which each month is positioned in a different face 13, thereby leaving 4 faces remaining for use with suspension means, magnetic means and adhesive means as further described below. In any case, the polyhedron should have at least 14 faces to allow use as a calendar.

It is to be understood that the present invention is not limited to the embodiments described above, but encompasses any and all embodiments within the scope of the following claims.

I claim:

1. A pop-up structure comprising:

a first sheet and an opposite second sheet identical to said first sheet;

each said sheet having a polygonal central panel having a plurality of edges, with a trapezoidal panel extending from each of said edges of said central panel;

each said trapezoidal panel having an inwardly folded flange with an inner edge, an outer edge, and inwardly tapering first and second lateral edges, and including a first attachment flange and a second attachment flange generally opposite said first attachment flange;

each corresponding said flange of said first sheet and said second sheet being secured together to define an equatorial plane of symmetry;

an elastic band extending from said first attachment flange to said second attachment flange, with said band providing tensile force for drawing said first attachment flange and said second attachment flange together, for erecting said first sheet and said second sheet for forming a symmetrical polyhedron;

said first attachment flange and said second attachment flange each including elastic band attachment means; and means for attaching said polyhedron to another article.

2. The pop-up structure according to claim 1, wherein said elastic band attachment means comprises a small first passage formed through each said attachment flange adjacent said inner edge thereof, and a large second passage formed through each said attachment flange adjacent said outer edge thereof;

each said first passage and each said second passage being in linear alignment with one another;

each said second passage including a peripheral point adjacent the corresponding said first passage, with a tab extending outwardly from each said peripheral point, into the corresponding said second passage; and said elastic band passing through each said first passage, looping around said tab of said corresponding said second passage, and applying a tensile force to each said attachment flange for erecting said first sheet and said second sheet for forming said polyhedron.

3. The pop-up structure according to claim 1, wherein said elastic band attachment means comprises a passage formed generally centrally through each said attachment flange, with said elastic band having a first and an opposite second end each having an elongate crossmember transversely and flexibly secured thereto and extending across said passage, for retaining the corresponding said end of said elastic band in the corresponding said attachment flange.

4. The pop-up structure according to claim 1, wherein said elastic band attachment means comprises a passage formed generally centrally through each said attachment flange with a slit extending from each said passage to one of said lateral edges, with said passage communicating with said one of said lateral edges by means of said slit; and said elastic band having a first end and a second end opposite said first end, with each said end having a knot formed therein, with each said end of said elastic band being passed along a corresponding said slit and being captured within the corresponding said passage by means of said knot.

5. The pop-up structure according to claim 1, wherein said means for attaching said polyhedron to another article comprises a magnet affixed to one said panel thereof, for temporarily magnetically securing said polyhedron to a magnetically attractive article.

6. The pop-up structure according to claim 1, wherein said means for attaching said polyhedron to another article comprises an elongate member secured to one said panel of said polyhedron, with said elongate member including a distal hook end for hanging said polyhedron from another article.

7. The pop-up structure according to claim 1, wherein said means for attaching said polyhedron to another article comprises at least one said panel having an adhesive coating thereon, for adhesively securing said polyhedron to another article.

8. The pop-up structure according to claim 1, wherein each said polygonal central panel includes at least three edges.

9. The pop-up structure according to claim 1, wherein each said polygonal central panel is a regular hexagon, with said polyhedron having a total of fourteen panels.

10. The pop-up structure according to claim 1, wherein each said polygonal central panel is a regular heptagon, with said polyhedron having a total of sixteen panels.

11. The pop-up structure according to claim 1, wherein each said sheet is formed of plastic.

12. The pop-up structure according to claim 1, wherein each said sheet is formed of paperboard.

* * * * *